US008230545B2

(12) United States Patent
Lee

(10) Patent No.: US 8,230,545 B2
(45) Date of Patent: Jul. 31, 2012

(54) VERSATILE CLEANING-USED DUSTER BROOM STRUCTURE

(75) Inventor: Pei Yuan Lee, Changhua Hsien (TW)

(73) Assignee: Rocktone Enterprise Co., Ltd., Changhua County (TW)

( * ) Notice: Subject to any disclaimer, the term of this patent is extended or adjusted under 35 U.S.C. 154(b) by 0 days.

(21) Appl. No.: 12/081,386

(22) Filed: Apr. 15, 2008

(65) Prior Publication Data

US 2011/0185524 A1 Aug. 4, 2011

(51) Int. Cl.
*A46B 5/00* (2006.01)

(52) U.S. Cl. ..... 15/229.2; 15/147.1; 15/189; 15/228

(58) Field of Classification Search ..... 15/159.1, 15/160, 228, 147.1, 189, 207.2, 151, 201, 15/229.1, 229.2
See application file for complete search history.

(56) References Cited

U.S. PATENT DOCUMENTS 3,187,363 A * 6/1965 Auwarter ..... 15/229.2
3,447,183 A * 6/1969 McClung et al. ..... 15/151
5,217,787 A * 6/1993 Monahan ..... 428/134

FOREIGN PATENT DOCUMENTS

EP 0629374 A1 * 12/1994
JP 2004-353133 A * 12/2004

OTHER PUBLICATIONS

Computer generated English translation of EP 0629374 A1, published Dec. 1994, Heitz.*
Computer generated English translation of JP 2004-353133 A, published Dec. 2004, Watabe et al.*

* cited by examiner

*Primary Examiner* — Laura C Guidotti
(74) *Attorney, Agent, or Firm* — Chi IP Law Firm

(57) ABSTRACT

A versatile cleaning-used duster broom structure comprises a dusting broom body composed of elastic soft bristles to fit to a coupling seat equipped with a handle. The coupling seat has an opening end to which the dusting broom body is accommodated and located thereto. The opening end has multiple conjoining blocks each defined by an insert groove thereon, and the dusting broom body has the surface bundled up into a collecting portion so that the elastic soft bristles can be more evenly arranged to match to a fixing pole thereby. Besides, each elastic soft bristle has multiple individual cellular suction portions, forming an elastic and dense bristle surface thereon to suck up fine particles of dust thereby. Thus, via the stretchable character of the suction portions thereof, the elastic soft bristles can accurately enwrap trash and clean up sand, dust and hair, etc., providing effective and effortless cleaning benefit thereby.

17 Claims, 19 Drawing Sheets

VERSATILE CLEANING-USED DUSTER BROOM STRUCTURE

BACKGROUND OF THE INVENTION

The present invention relates to a versatile cleaning-used duster broom structure, comprising a dusting broom body composed of elastic soft bristles to fit to a coupling seat equipped with a handle, forming a cleaning device thereby wherein each elastic soft bristle has multiple cellular suction portions disposed thereon to form an elastic and dense bristle surface so as to suck up fine particles of sand, dust and hair, etc., providing effective and effortless cleaning benefit thereby.

Conventionally, a broom is composed of natural beard of plants like silver grasses or synthetic fibers that are bundled up into a tuft of bristles and combined with a connecting section and a handle to provide a cleaning device thereby. In application, the hairy bristles of the broom are applied to sweep and clean up trash and dust. However, the bristles of the conventional broom are densely bundled up to form upright and hard bristles. When the broom is applied to sweep and collect trash, the bristles passing to and forth can easily stir up dust on the ground and make fine particles of the dust permeate the air, which is quite uncomfortable and harmful to the user thereof.

SUMMARY OF THE PRESENT INVENTION

It is, therefore, the primary purpose of the present invention to provide a versatile cleaning-used duster broom structure wherein a dusting broom body composed of elastic soft bristles is mounted to a coupling seat equipped with a handle, forming a cleaning device thereby, and each elastic soft bristle has multiple individual cellular suction portions disposed thereon to form an elastic and dense bristle surface so as to suck up fine particles of dust; whereby, the cellular net-like suction portions thereof are utilized to collect tiny grains of sand, dust and hair onto the elastic soft bristles thereof so as to avoid stirring up dust into the air, achieving the best application state thereby.

It is, therefore, the second purpose of the present invention to provide a versatile cleaning-used duster broom structure wherein the elastic soft bristles of the dusting broom body have one or more than one collecting portions bonded at the center thereon to match to a fixing pole; whereby, the dusting broom body can be flexibly mounted to different types of coupling seats equipped with conjoining blocks thereon and freely assembled to provide various kinds of cleaning devices such as a vertical-type broom or a sidelong-used duster, facilitating cleaning jobs of different nature and achieving versatile application of the present invention thereby.

DETAILED DESCRIPTION OF THE PREFERRED EMBODIMENTS

Figure 1:
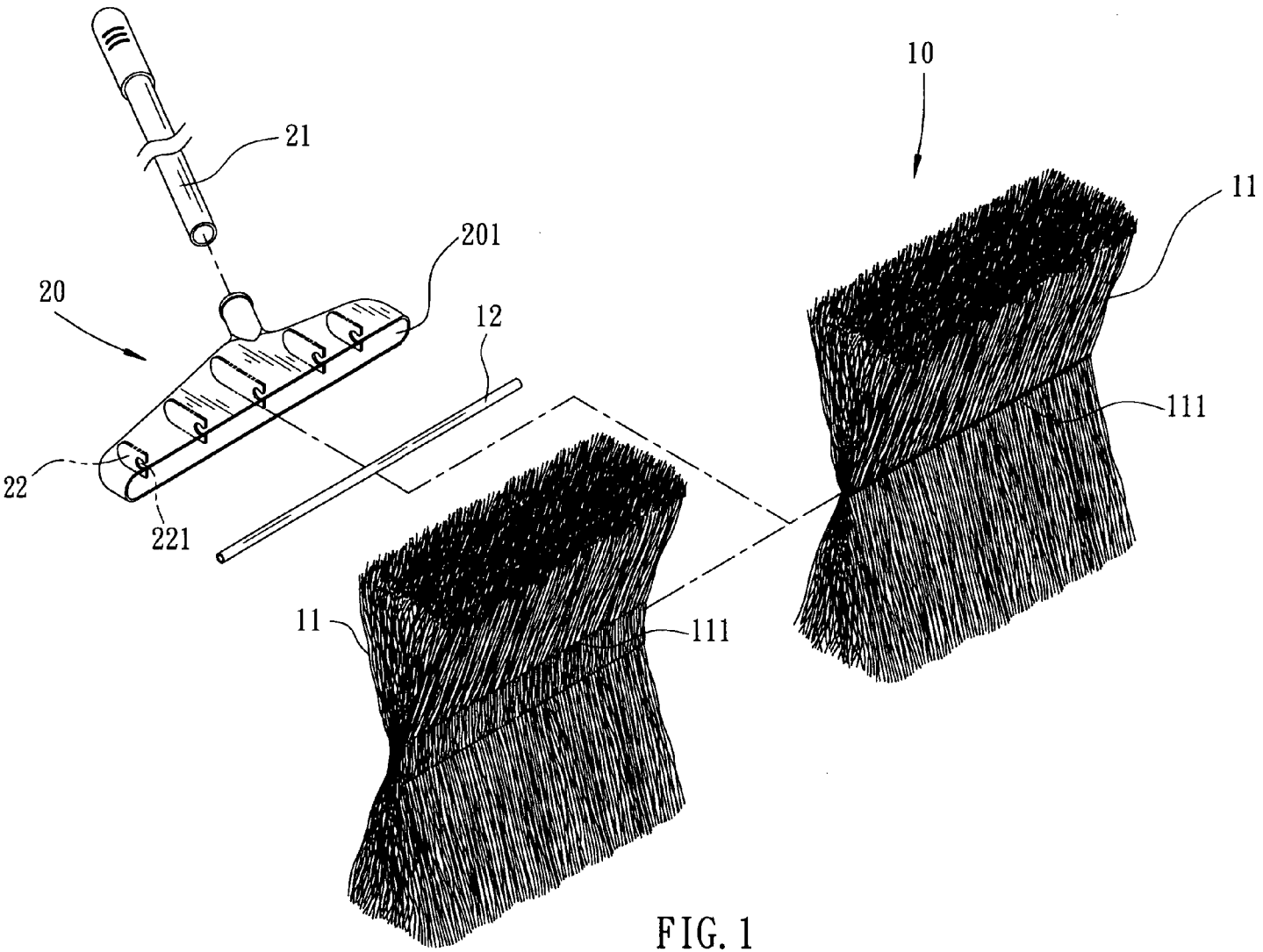
FIG. 1 is an exploded perspective view of the present invention.
Figure 2:
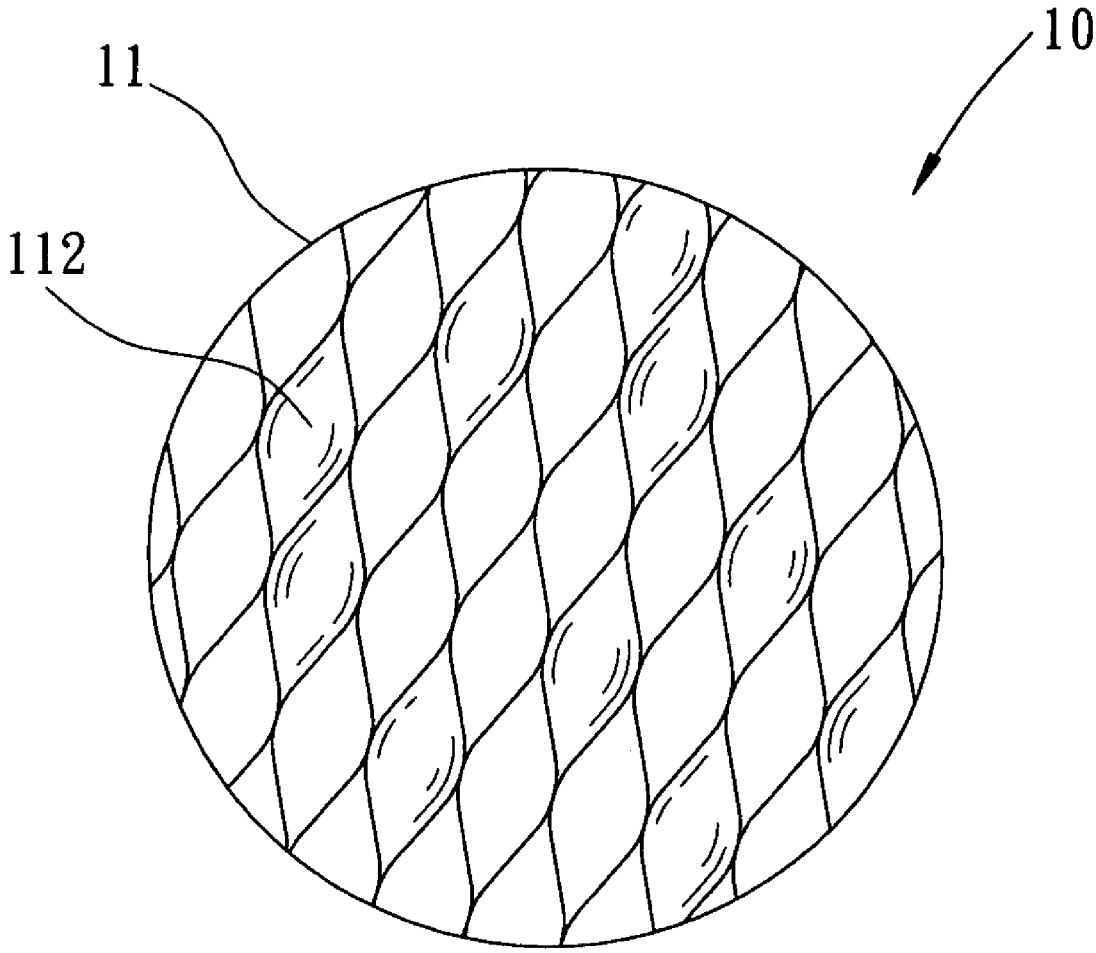
FIG. 2 is a partially enlarged view of an elastic soft bristle of the present invention.
Figure 3:
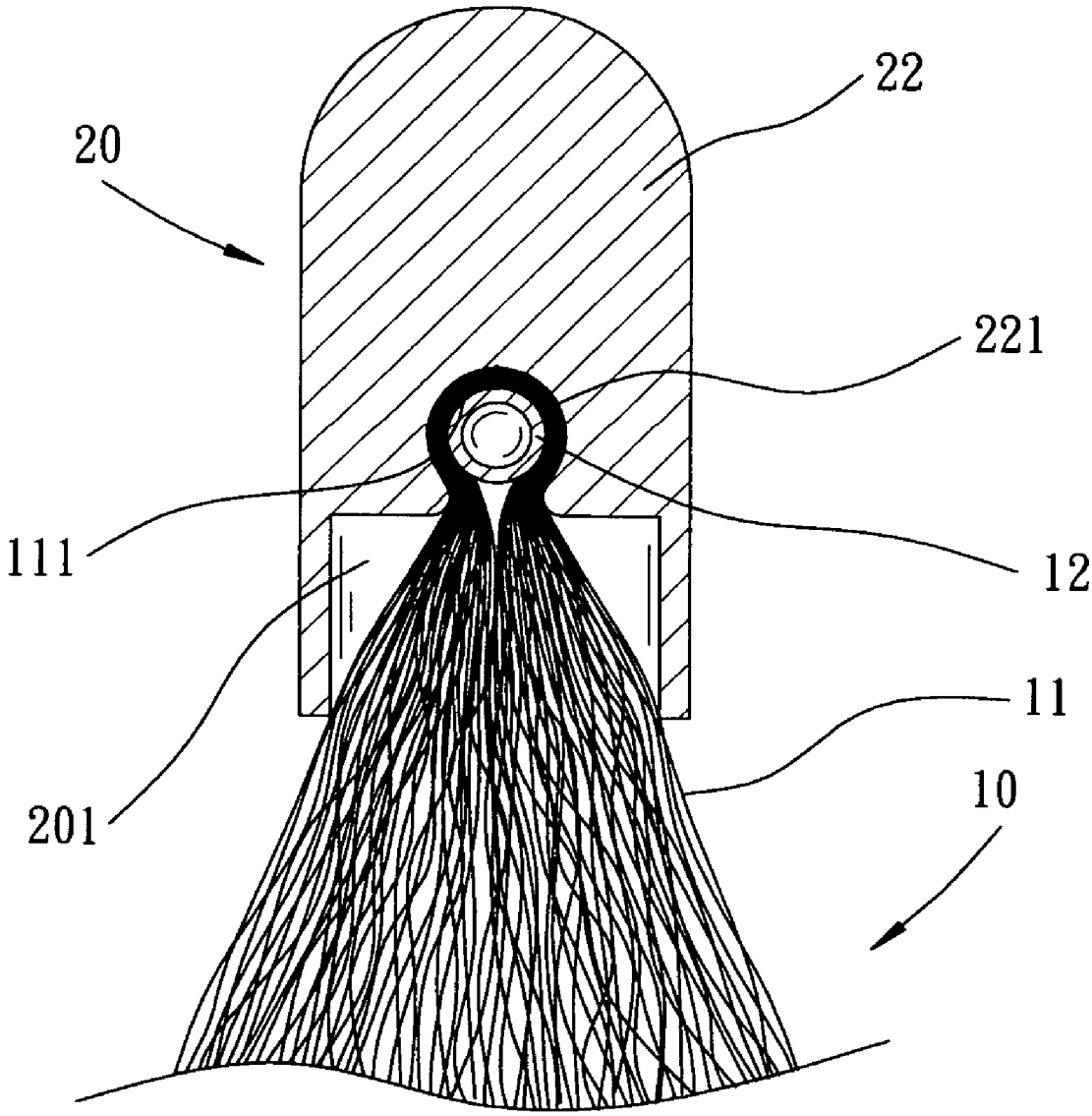
FIG. 3 is an assembled cross sectional view of the present invention.

Please refer to FIG. 1 showing an exploded perspective view of the present invention. The present invention relates to a versatile cleaning-used duster broom structure, comprising a dusting broom body 10 made up of elastic soft bristles 11 (which can be composed of bamboo charcoal material) to fit to a coupling seat 20 equipped with a handle 21, forming a cleaning device thereby. The coupling seat 20 has one side equipped with an opening end 201 to which the dusting broom body 10 is mounted and engaged therewith. The opening end 201 has the interior equipped with multiple U-shaped conjoining blocks 22 each defined by an insert groove 221 thereon. The elastic soft bristles 11, made up of artificial woolen-like material and bundled up into a hairy bunch, have the center bonded into one or two layers of collecting portions 111 via ultrasonic-fastening, weave-binding, or electric-thermo-pressing operation. Thus, the elastic soft bristles 11 can be more evenly and accurately arranged and distributed to match to a fixing pole 12, permitting both upper and lower sections of the elastic soft bristles 11 to sequentially augment in thickness and loosely stretch in an outspreading shape. Besides, each of the elastic soft bristles 11 has multiple individual cellular net-like suction portions 112 disposed thereon (referring to FIG. 2) to form an elastic and dense bristle surface equipped with elasticity so as to suck up fine particles of dust thereby. Via the stretchable character of the cellular net-like suction portions 112, the fixing pole 12 can be applied to abut against the collecting portion 111, and the elastic soft bristles 11 can be doubled up from top to bottom, permitting the fixing pole 12 to be hidden inside the elastic soft bristles 11 thereby. Then, the collecting portion 111 of the elastic soft bristles 11 will have a rod-shaped extruded section extending at the outer surface thereon to be precisely fitted into the insert grooves 221 of the conjoining blocks 22 and accommodated into the opening end 201 (referring to FIG. 3) so as to assemble the dusting broom body 10 firmly onto the coupling seat 20 thereby. Therefore, when the dusting broom body 10 passes and contacts trash on the ground, the suction portions 112 of the elastic soft bristles 11 with the cellular net-like design allow the elastic soft bristles 11 to stretch and bounce up so as to enwrap the trash therein. Meanwhile, when the elastic soft bristles 11 are pressed again, the suction portions 112 will bounce up again to sweep out trash and dust simultaneously so as to avoid stirring up the dust and dirtying the air thereby. Therefore, the dusting broom body 10 can easily gather up fine grains of sand, dust, and hair, etc. to be swiftly cleaned up there-from, achieving effortless and durable application of the present invention for better cleaning effect thereby.

Figure 4:
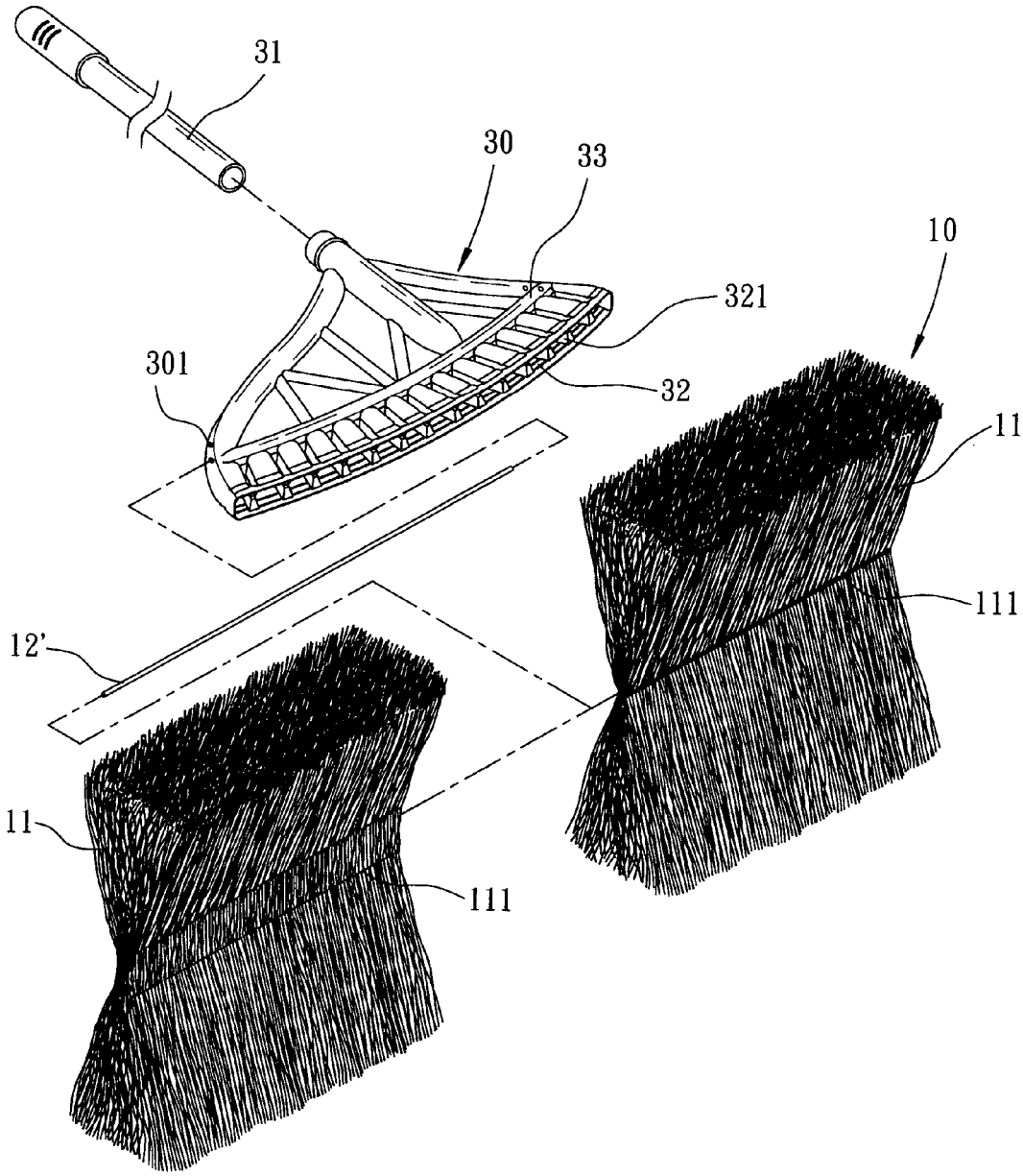
FIG. 4 is an exploded perspective view of another embodiment of the present invention.
Figure 5:
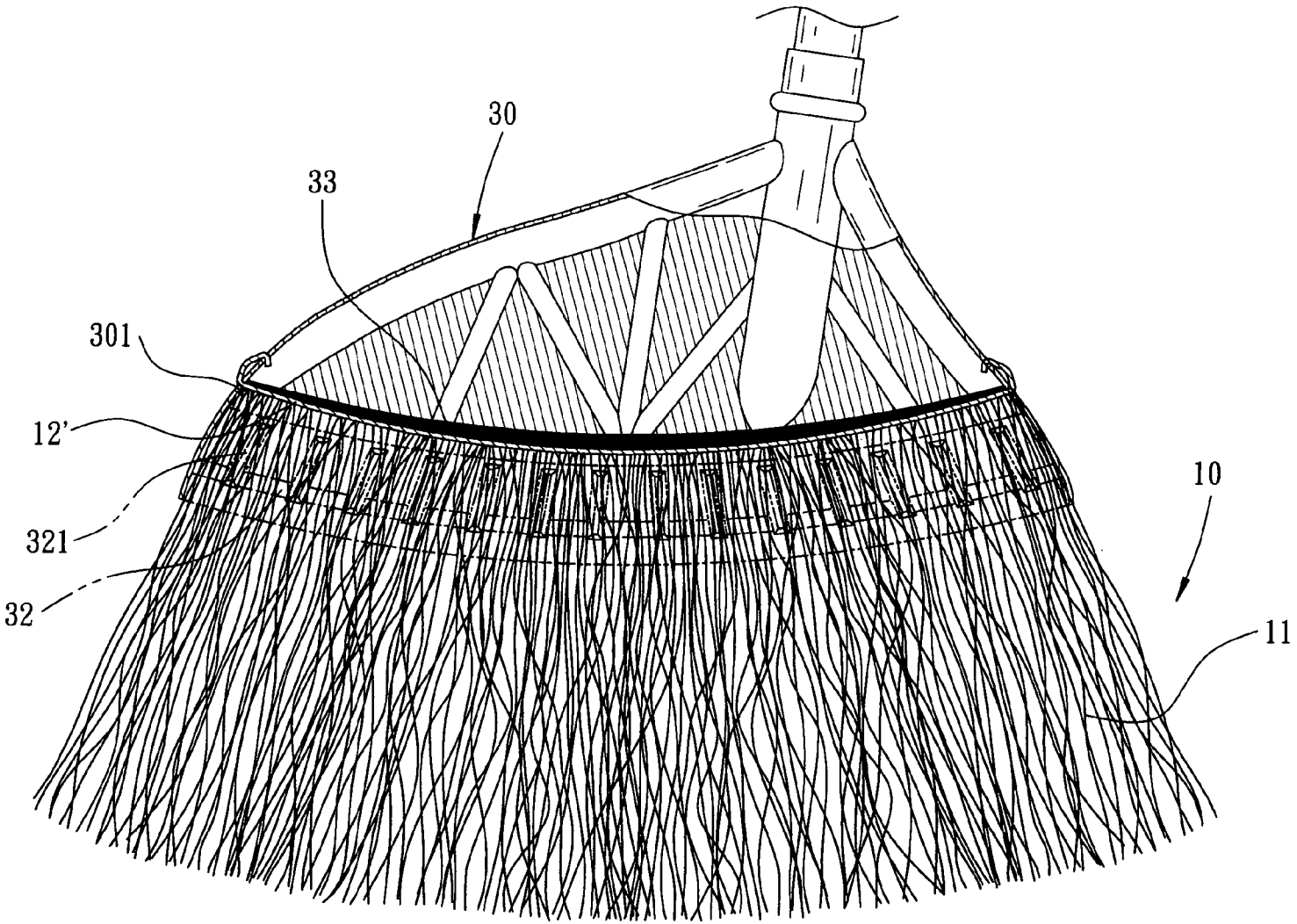
FIG. 5 is an assembled cross sectional view of another embodiment of the present invention.

The dusting broom body 10 can also fit to a coupling seat 30 equipped with a coupling section 32 and a handle 31 (referring to FIG. 4). The coupling section 32 has multiple insert teeth 321 spaced out in a row at the interior therein. And the coupling seat 30 has both left and right lateral sides respectively drilled with multiple symmetrical through-holes 301 to which a flexible iron-wired fixing pole 12' is guided to extend there-through. The coupling seat 30 also includes a conjoining section 33 extending on top of the insert teeth 321 so as to hold in place the fixing pole 12' accommodated inside the elastic soft bristles 11 thereof. Then, the collecting portion 111 of the elastic soft bristles 11 and the fixing pole 12' are allowed to accommodate and conceal inside the conjoining section 33, permitting both ends of the fixing pole 12' to precisely extend outwards through the through-holes 301 disposed at both lateral sides of the coupling seat 30 to be fixed and located thereto. Therefore, the collecting portion 111 and the fixing pole 12' are allowed to hide and position inside the conjoining section 33 as shown in FIG. 5, forming a vertical-type broom for application thereby.

Figure 6:
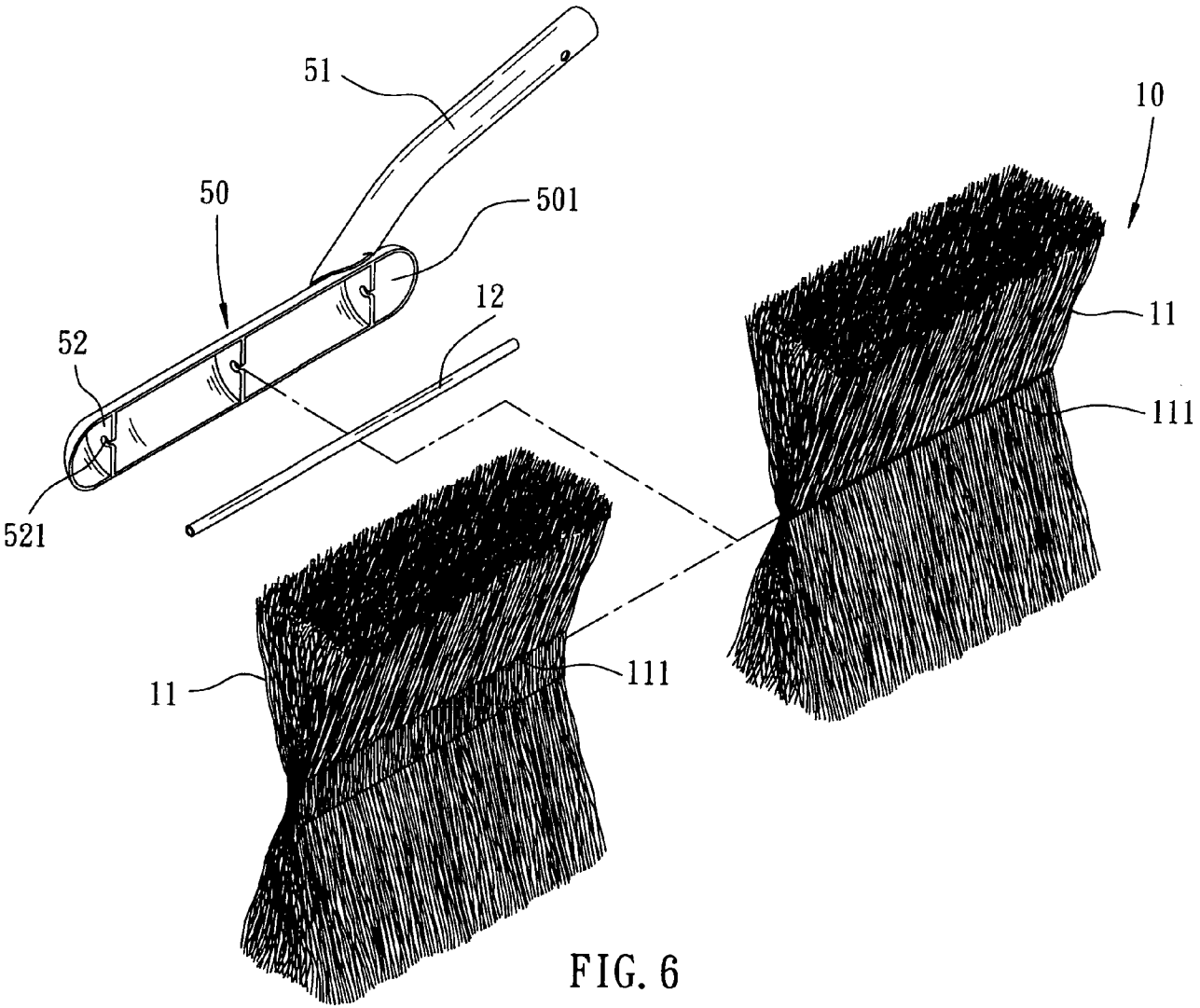
FIG. 6 is an exploded perspective view of a third embodiment of the present invention.
Figure 7:
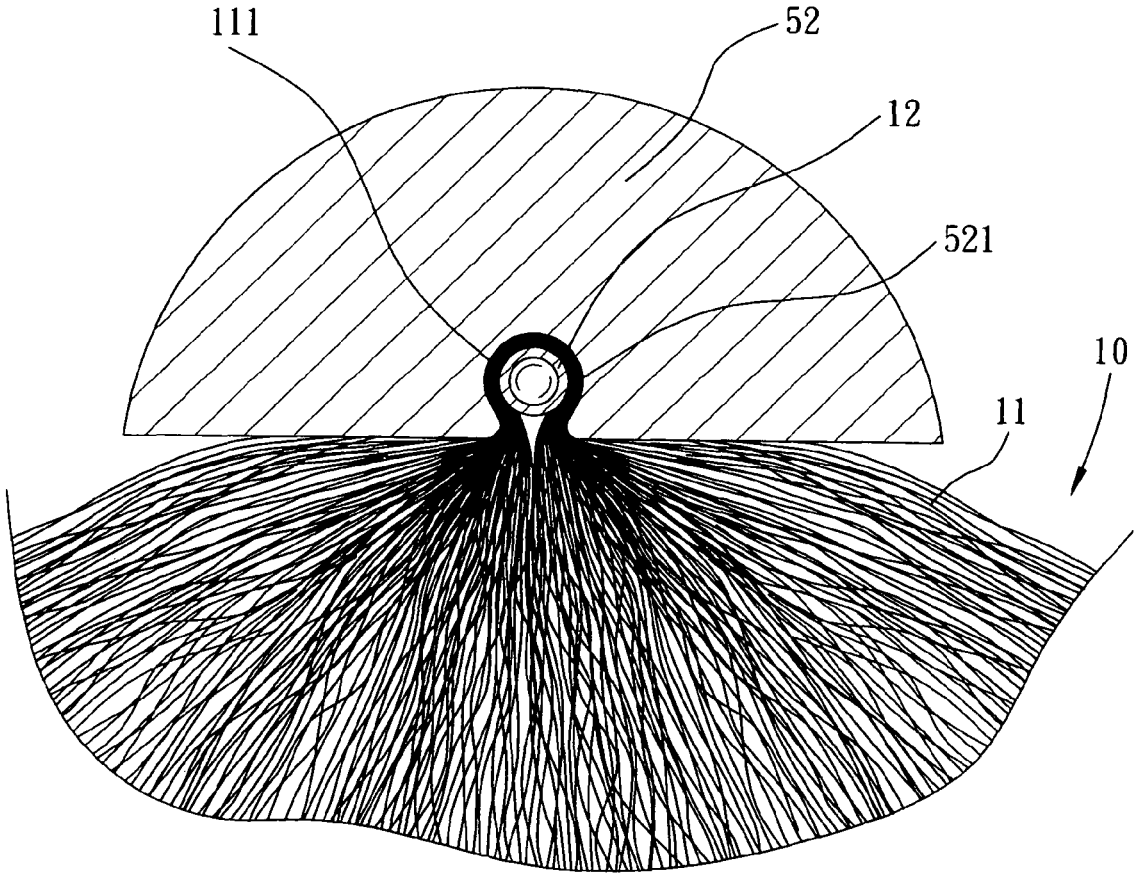
FIG. 7 is an assembled cross sectional view of the present invention shown in FIG. 6.
Figure 8:
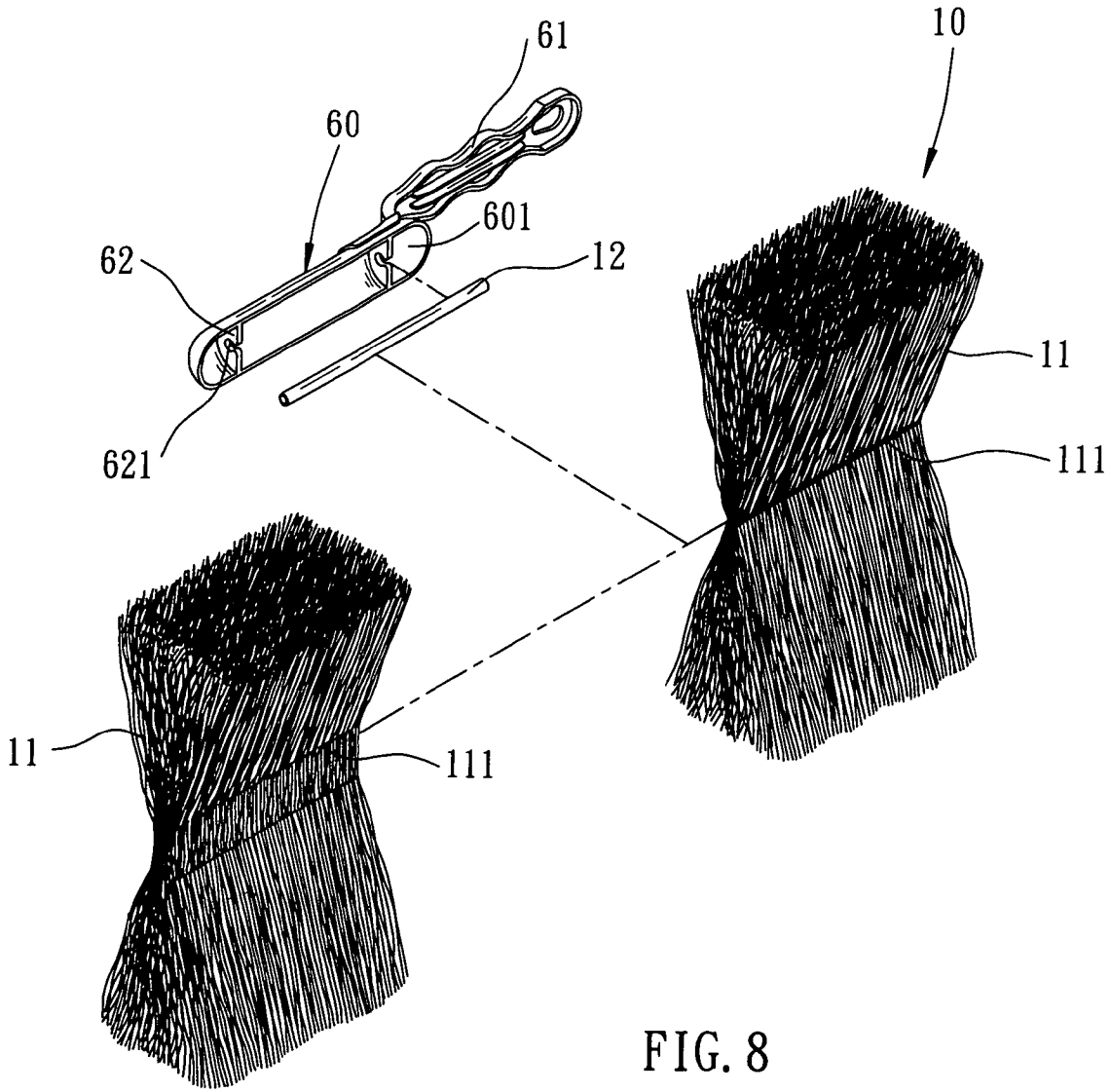
FIG. 8 is an exploded perspective view of a fourth embodiment of the present invention.
Figure 9:
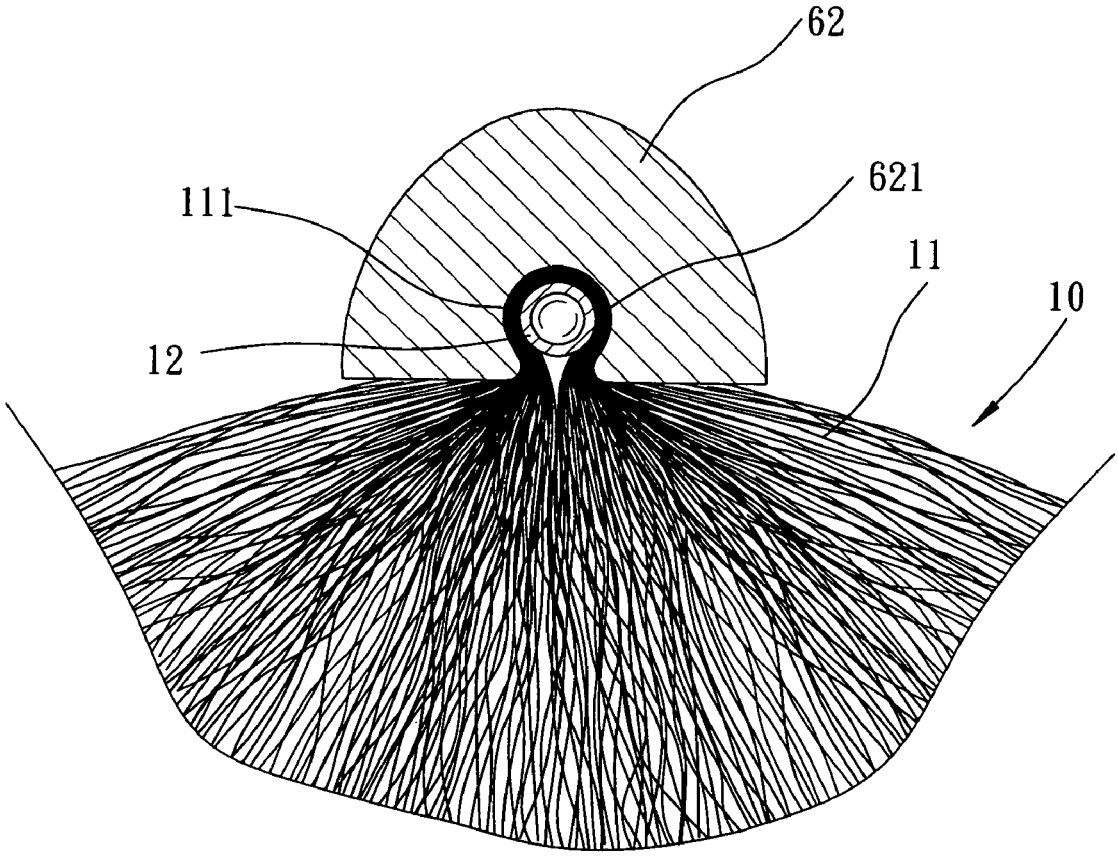
FIG. 9 is an assembled cross sectional view of the present invention shown in FIG. 8.
Figure 10:
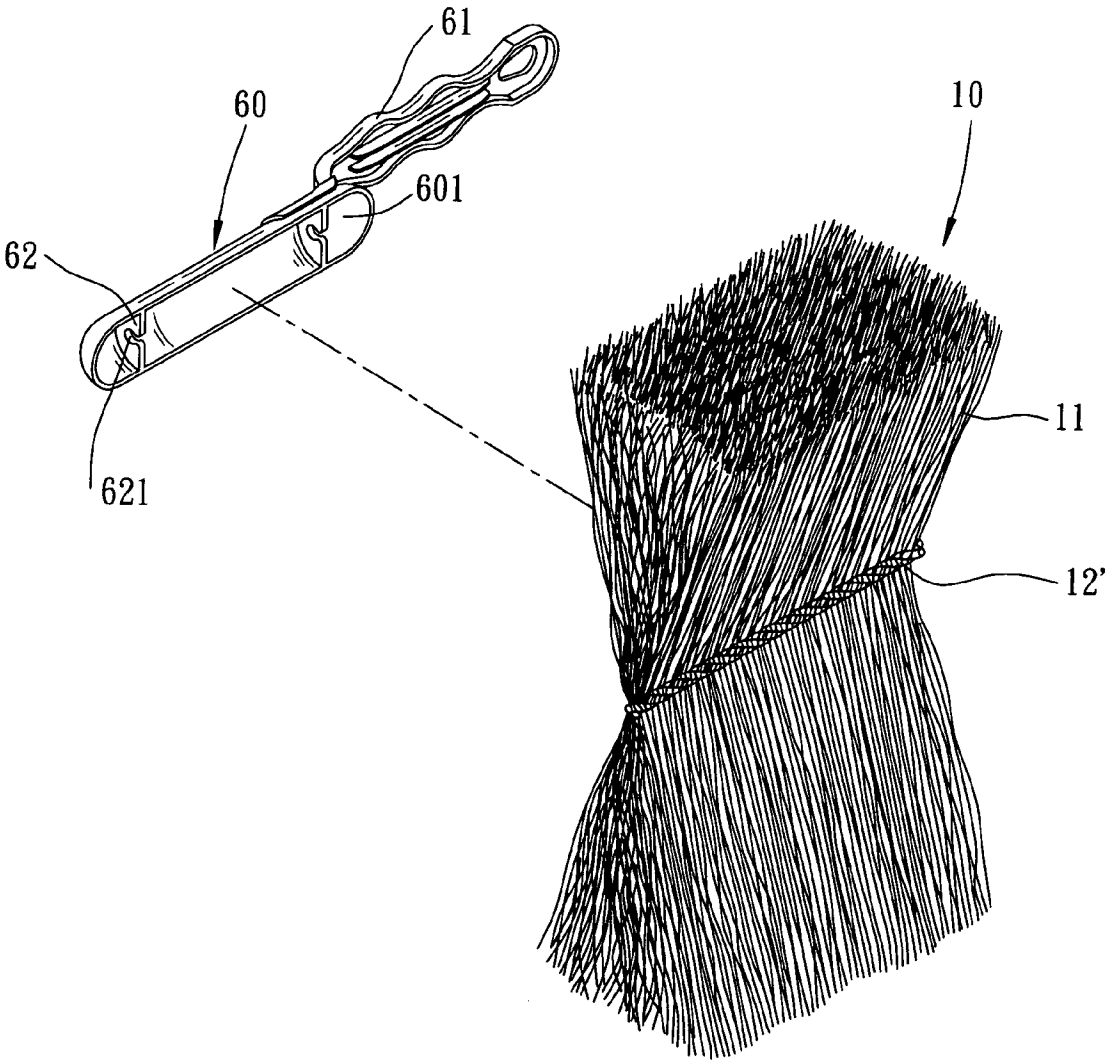
FIG. 10 is an exploded perspective view of a fifth embodiment of the present invention.
Figure 11:
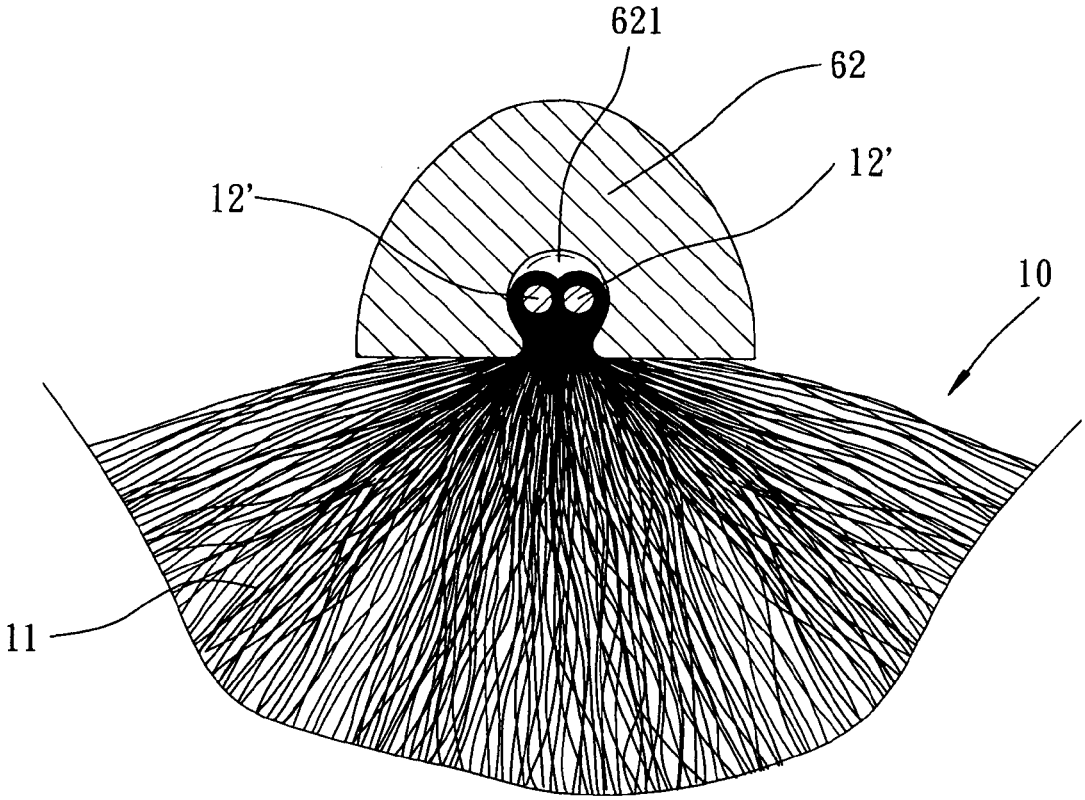
FIG. 11 is an assembled cross sectional view of the present invention shown in FIG. 10.

Moreover, the dusting broom body 10 can also be mounted to various types of coupling seats 50, 60 equipped with different handles 51, 61 respectively. The coupling seats 50, 60 are respectively equipped with an opening end 501, 601 having multiple conjoining blocks 52, 62 each defined by an insert groove 521, 621 thereon (referring to FIGS. 6, 8). The fixing pole 12 is applied to abut against the collecting portion 111 and the elastic soft bristles 11 are doubled up from top to bottom. Then, the fixing pole 12 concealed inside the elastic soft bristles 11 is mounted into the insert grooves 521, 621 of the conjoining blocks 52, 62 and held in place thereto as shown in FIGS. 7, 9. Thus, the dusting broom body 10 can be assembled to the coupling seats 50, 60 respectively to form a sidelong-used dusting device thereby. Meanwhile, the collecting portion 111 of the elastic soft bristles 11 can also be wound and bundled up by a flexible iron-wired fixing pole 12' as shown in FIG. 10. In assembly, the elastic soft bristles 11 bundled up by the fixing pole 12' can be directly squeezed into the insert grooves 621 of the conjoining blocks 62 and held in place thereto as shown in FIG. 11, forming another type of cleaning-used dusting body thereby. Thus, the dusting broom body 10 can be freely assembled to provide versatile cleaning devices, facilitating cleaning jobs of different nature thereby.

Figure 12:
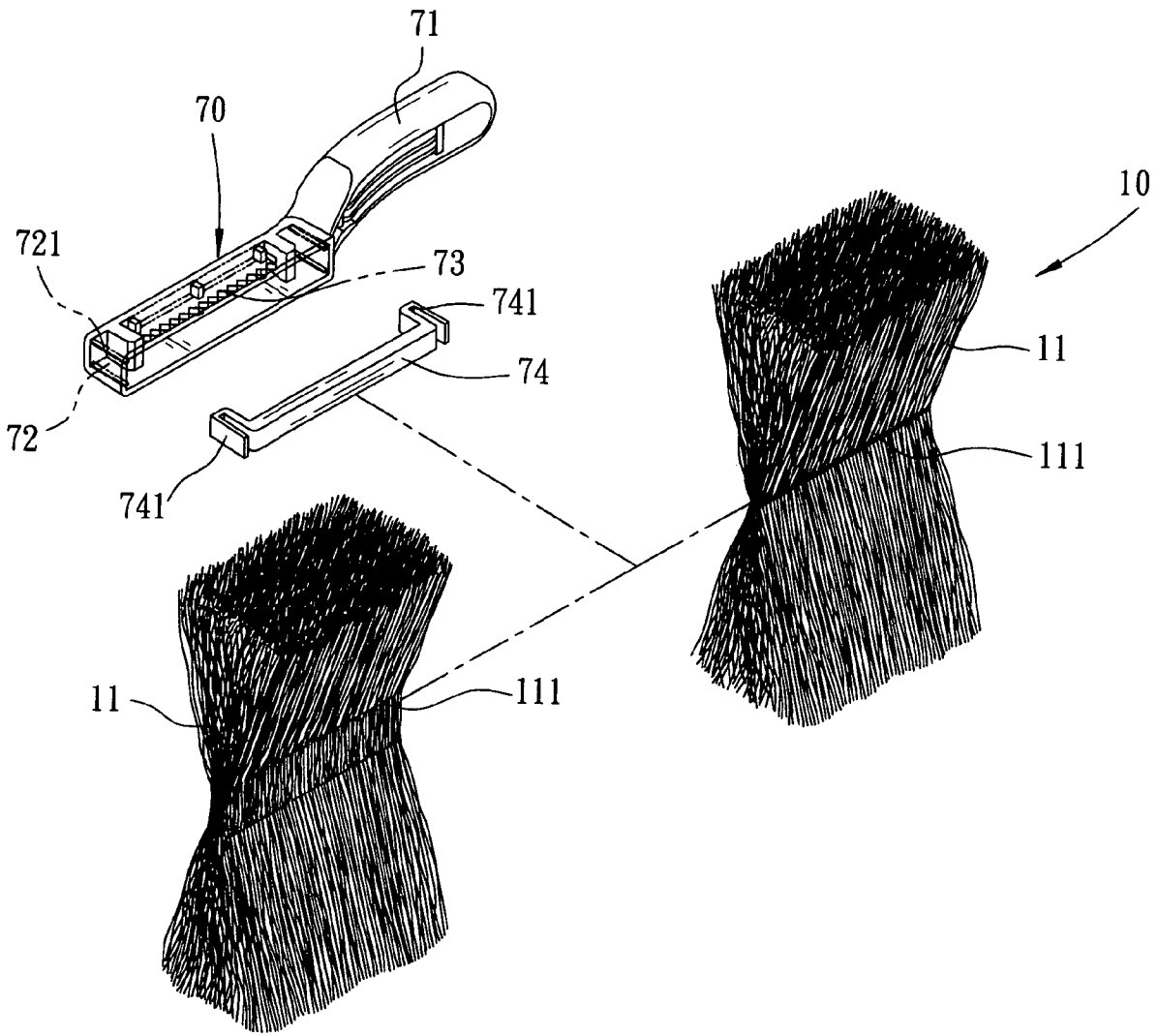
FIG. 12 is an exploded perspective view of a sixth embodiment of the present invention.
Figure 13:
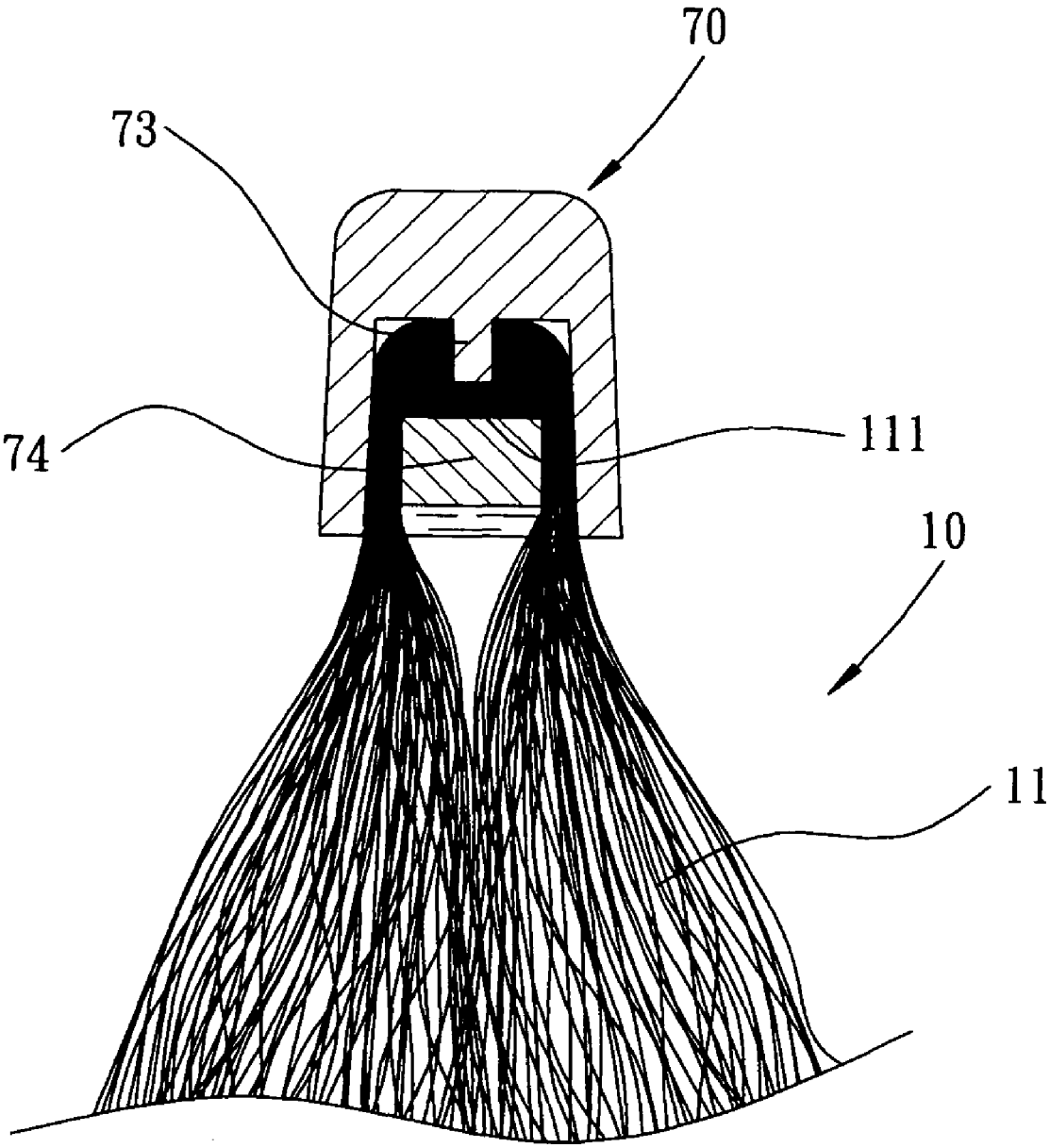
FIG. 13 is an assembled cross section view of the present invention shown in FIG. 12.

Besides, the dusting broom body 10 can also be mounted to a coupling seat 70 equipped with a handle 71 wherein the coupling seat has both left and right end sides each defined by an abutment groove 72 and the middle section equipped with an insert toothed section 73 (referring to FIG. 12). A fixing pole 74 molded in a U-shaped configuration and having an engaged end 741 extending at both left and right end sides thereon respectively is provided, and the abutment groove 72 thereof has a set of engaging blocks 721 symmetrically extending at one side surface thereon, to which the engaged end 741 is joined to abut and locate thereto. Then, the fixing pole 74 is applied to abut against the collecting portion 111 and the elastic soft bristles 11 are doubled up from top to bottom. And the engaged ends 741 extending at both sides of the fixing pole 741 can be mounted into the abutment grooves 72 and held firmly in place by the engaging blocks 721 as shown in FIG. 13. Thus, the dusting broom body 10 can be flexibly assembled to the coupling seat 70 for application, boosting the competitive edge of the present invention thereby.

Figure 14:
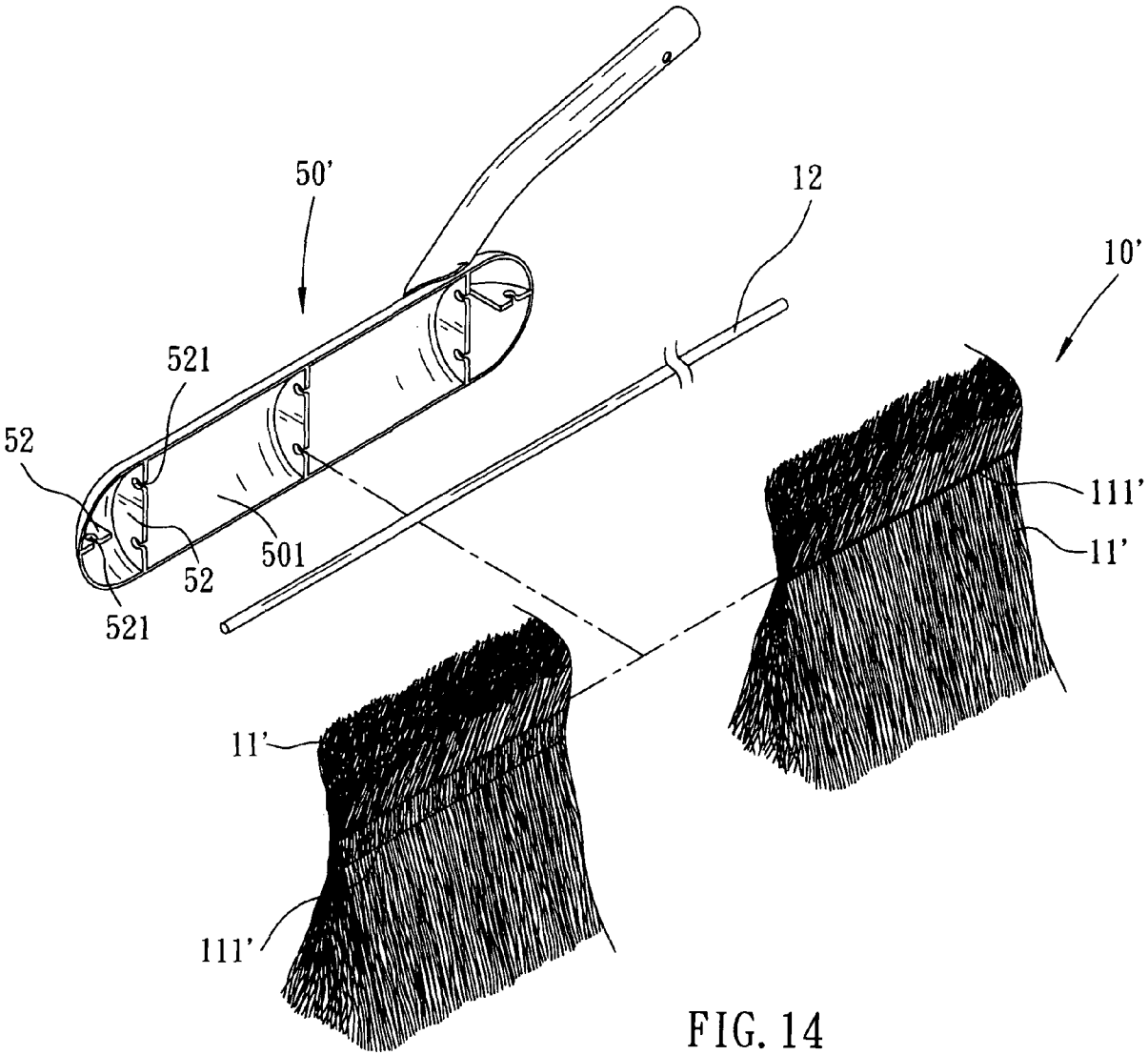
FIG. 14 is an exploded perspective view of a seventh embodiment of the present invention.
Figure 15:
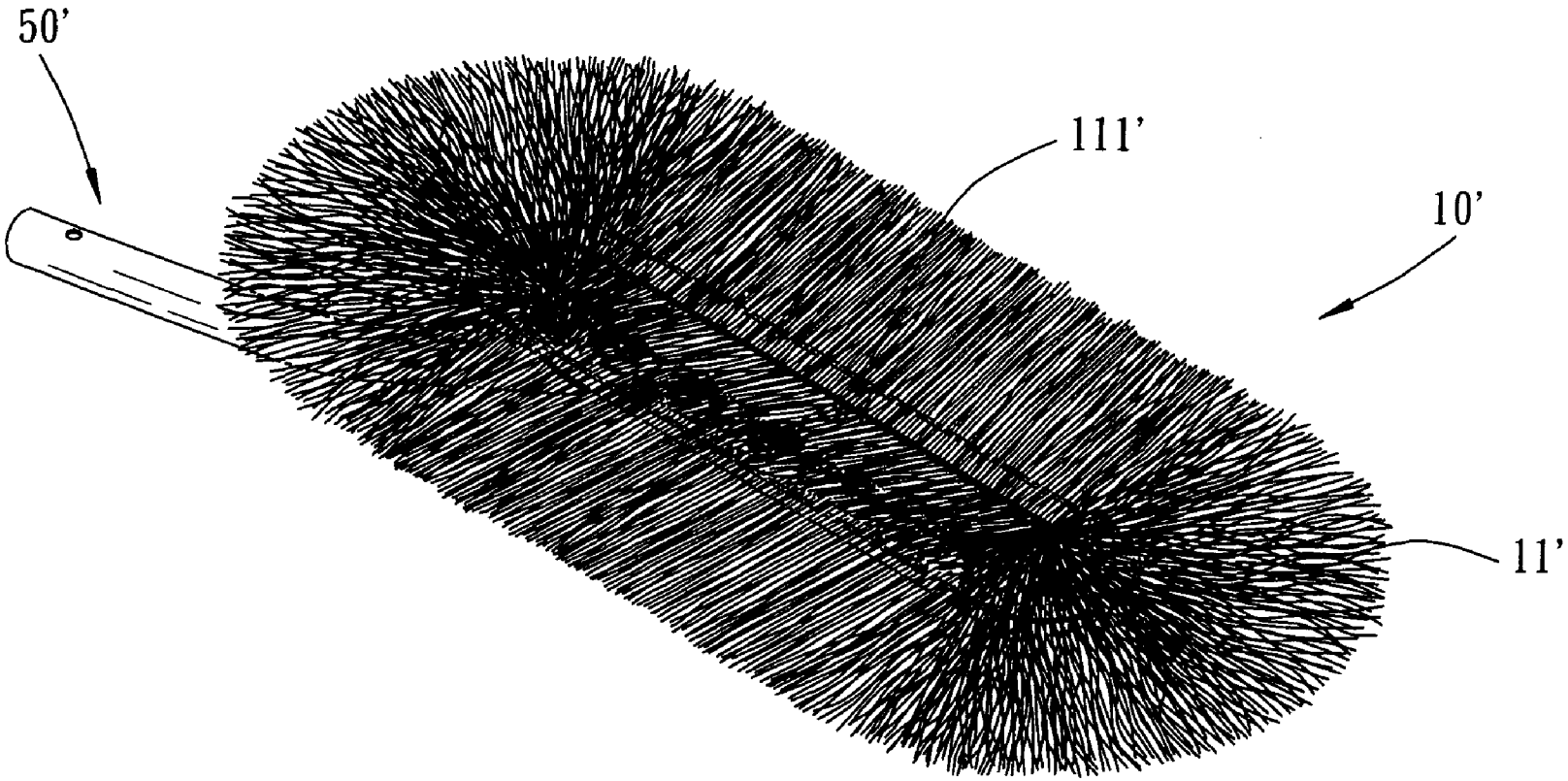
FIG. 15 is an assembled cross section view of the present invention shown in FIG. 14.

Please refer to FIG. 14. The present invention can also include a coupling seat 50' equipped with an opening end 501 wherein the opening end 501 has the interior equipped with a horizontal conjoining block 52 with an insert groove 521 extending at both left and right wing sides thereon respectively, and multiple vertical conjoining blocks 52 with insert grooves 521 spaced out at the middle section therein. Besides, a dusting broom body 10' is equipped with appropriate-length elastic soft bristles 11' whose surface is bonded by one or two layers of equal-length collecting portions 111' to precisely match to a flexible iron-wired fixing pole 12' thereby. Thus, the fixing pole 12' mounted to the dusting broom body 10' can be guided to wind through each horizontal and vertical conjoining block 52 and squeezed into each insert groove 521 for location thereto so as to mount the dusting broom body 10' onto the coupling seat 50' as shown in FIG. 15, forming another type of dusting device for application thereby.

Figure 16:
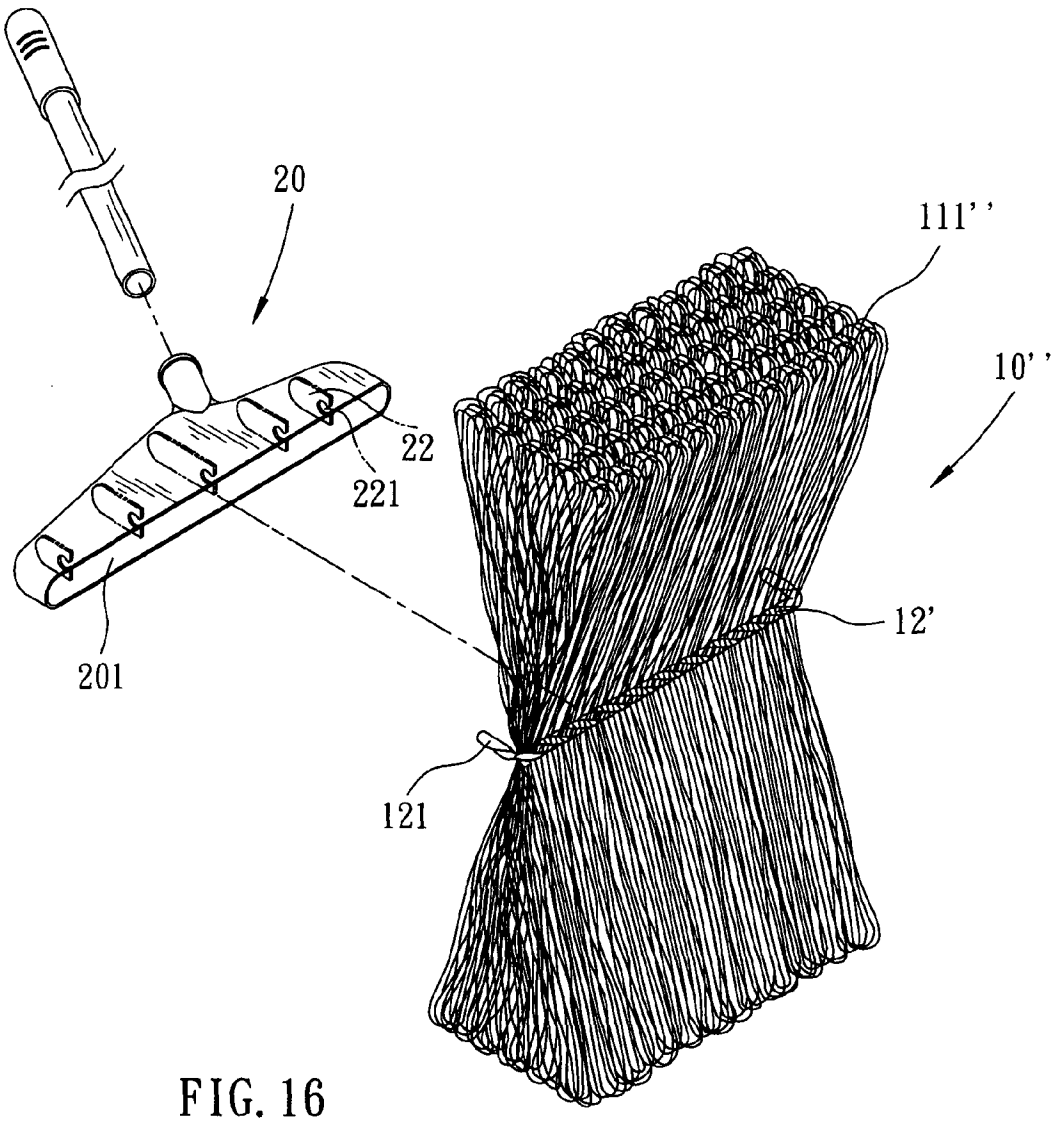
FIG. 16 is an exploded perspective view of an eighth embodiment of the present invention.

Please refer to FIG. 16. The present invention can also have a dusting broom body 10" equipped with elastic soft bristles 11" each wound into a twisted shape. The elastic soft bristles 11" can be bundled up by a flexible iron-wired fixing pole 12' with a fixing end 121 extending at both ends thereon to form a dusting broom body 10" thereby. Then, the fixing ends 121 extending at both left and right lateral sides of the dusting broom body 10" can have glue material coated thereon to be fastened onto both internal left and right sides of the opening end 201 of the coupling seat 20 thereby while the fixing pole 12' is applied to mount to the insert grooves 221 of the conjoining blocks 22 and held in place thereto. Therefore, the dusting broom body 10" equipped with the twisted elastic soft bristles 11" can be easily and evenly applied to sweep and clean up large amount of sand, dust, and hair, etc., greatly boosting the economical benefit of the present invention thereby.

Figure 17:
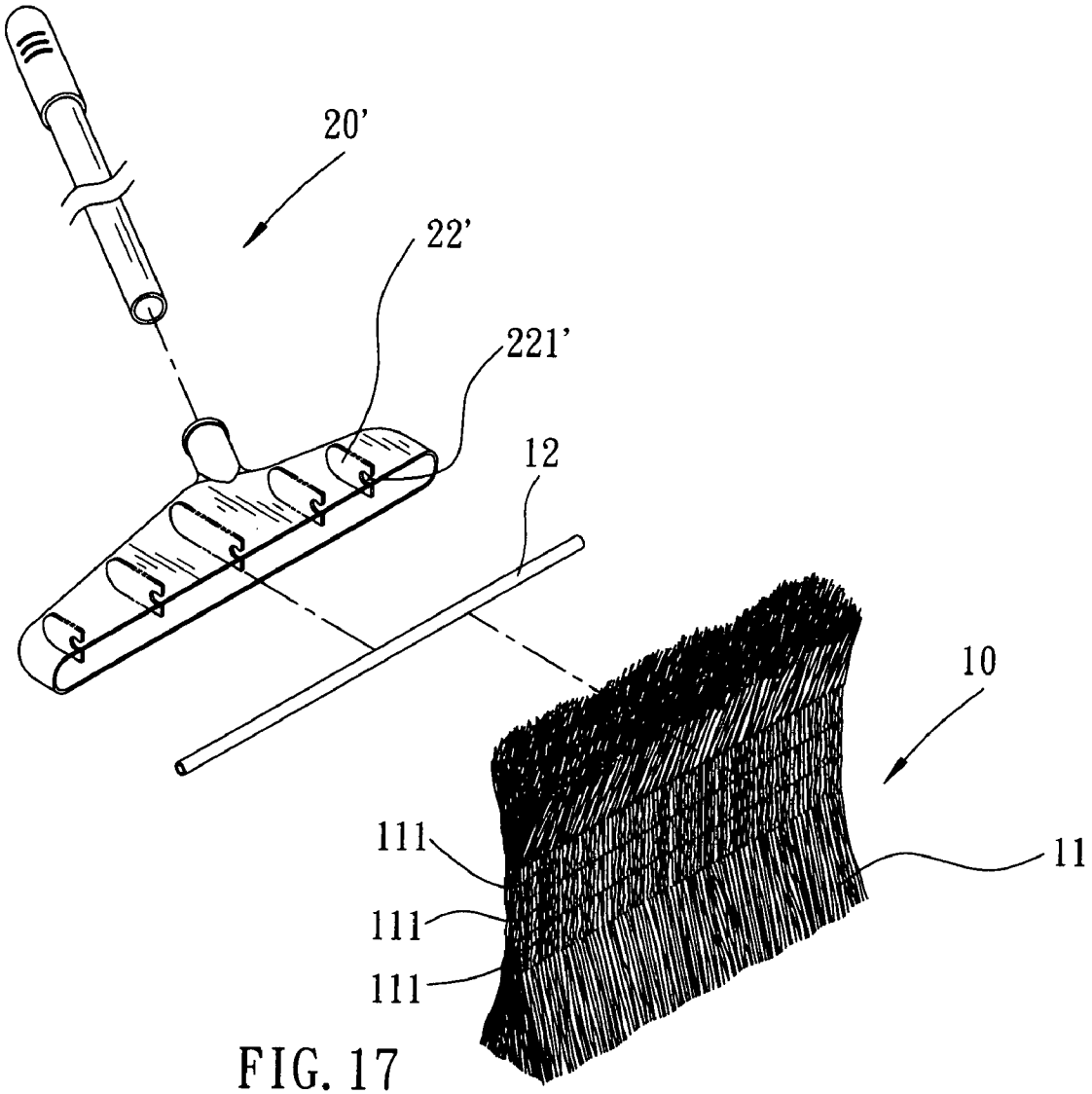
FIG. 17 is an exploded perspective view of a ninth embodiment of the present invention.
Figure 18:
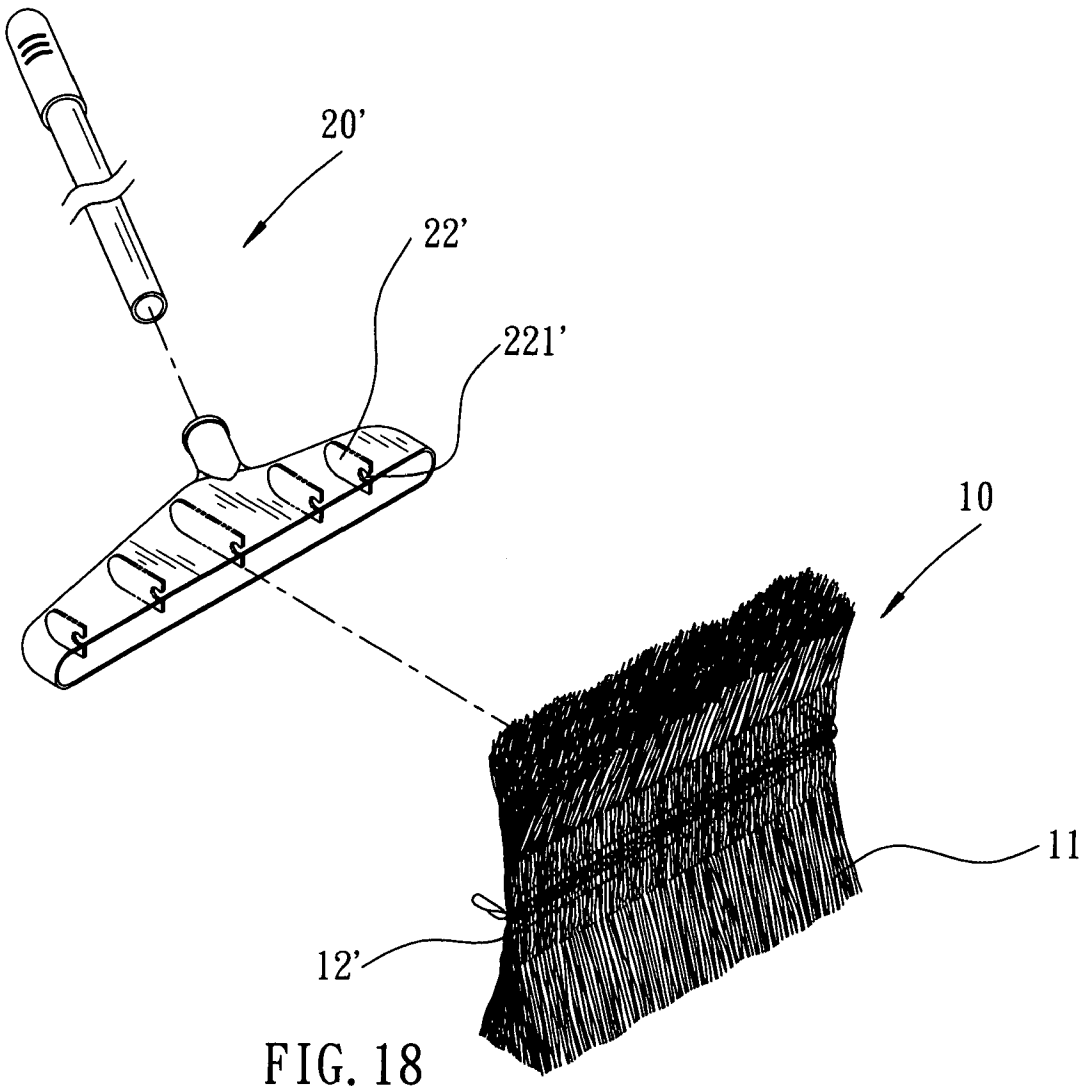
FIG. 18 is an exploded perspective view of a tenth embodiment of the present invention.
Figure 19:
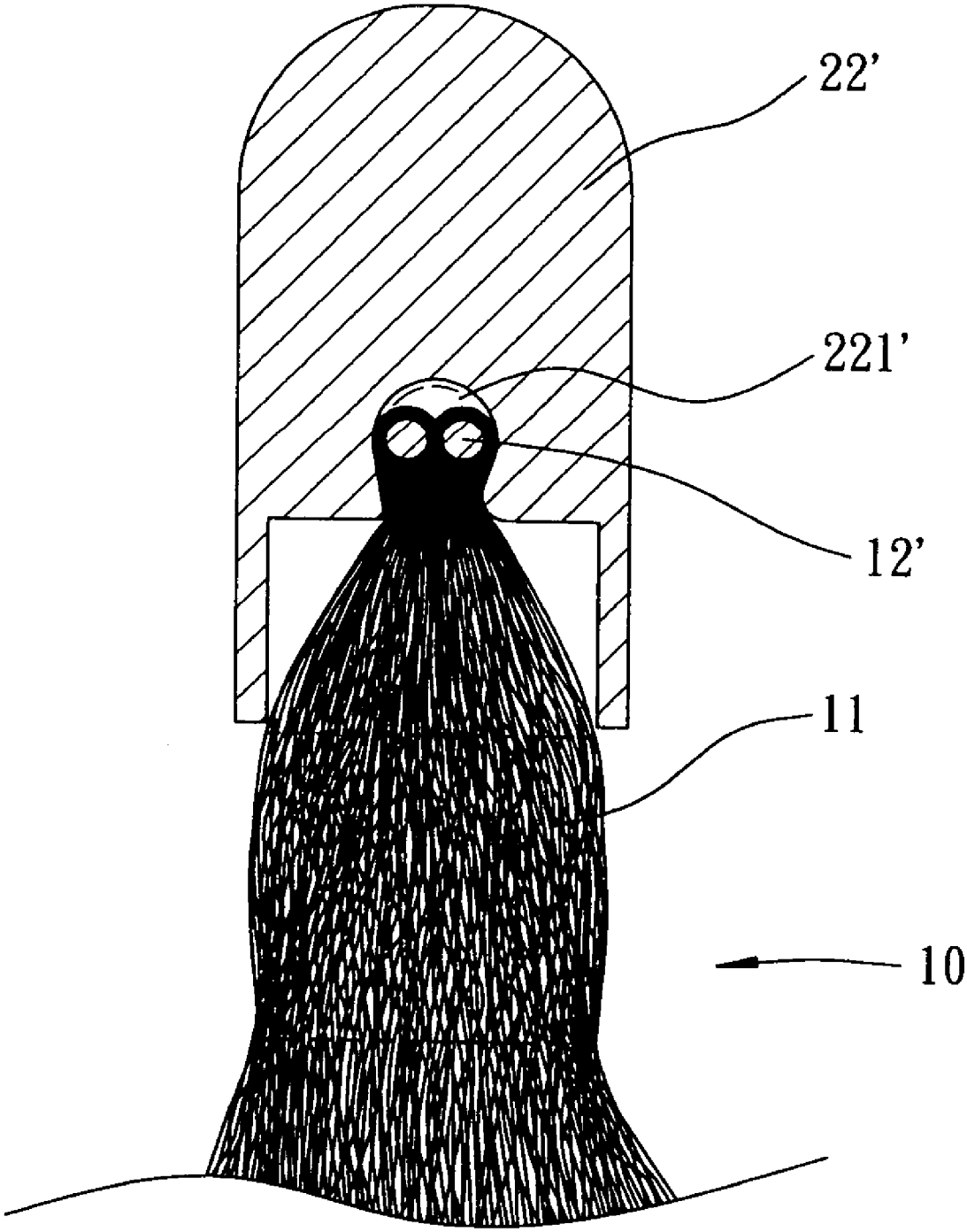
FIG. 19 is an assembled cross section view of the present invention shown in FIG. 18.

Please refer to FIG. 17. The present invention can also include a coupling seat 20' equipped with multiple conjoining blocks 22' each defined by a front-narrow-and-rear-wide insert groove 221', and the elastic soft bristles 11 thereof can also have more than two layers of collecting portions 111 bonded thereon. Thus, to assemble the dusting broom body 10 onto the coupling seat 20', the fixing pole 12 is first mounted to the dusting broom body 10, permitting the elastic soft bristles 11 to form a rod-shaped extruded section that is guided to accurately fit into the insert grooves 221' of the conjoining blocks 22' and firmly held in abutting location thereto. Besides, a flexible iron-wired fixing pole 12' can also be applied to match to the dusting broom body 10 as shown in FIG. 18. And the fixing pole 12 abutting and hidden inside the elastic soft bristles 11 can be squeezed through the front-narrow-and-rear-wide insert grooves 221' of the conjoining blocks 22' respectively and firmly held in place thereto, ensuring more accurate connection thereby. Meanwhile, the elastic soft bristles 11 with more than two layers of the collecting portions 111 disposed thereon and doubled up from top to bottom can be more evenly accommodated into the interior of the opening end 201 as shown in FIG. 19, protecting the completeness of the dusting broom body 10 as a whole to avoid deformation and make it more durable in application thereby.

What is claimed is:

1. A versatile cleaning-used duster broom structure, comprising:

a dusting broom body composed of elastic soft bristles, and a coupling seat equipped with a handle to fit to the dusting broom body;

wherein the coupling seat has one side defined by an opening end to which the dusting broom body is accommodated and located thereto, the opening end having an interior equipped with multiple conjoining blocks each defined by an insert groove thereon, and wherein the dusting broom body has a surface bonded into a collecting portion for arranging and distributing the elastic soft bristles evenly to match to a fixing pole thereby, wherein each of the elastic soft bristles has multiple individual cellular suction portions disposed thereon, wherein the elastic soft bristles form a dense bristle surface equipped with elasticity so as to suck up fine particles of dust, wherein, via the stretchable character of the cellular suction portions thereof, the elastic soft bristles expand and bounce up to enwrap trash therein, and wherein the elastic soft bristles fit to a coupling seat that has the opening end equipped with horizontal smaller-surfaced conjoining blocks with insert grooves extending at both left and right wing sides, and vertical larger-surfaced conjoining blocks with insert grooves spaced out at the middle section thereon, whereby the elastic soft bristles have the surface bonded by an equal-length collecting portion to match to a flexible-wire fixing pole.

2. The versatile cleaning-used duster broom structure as claimed in claim 1 wherein the conjoining blocks of the coupling seat being respectively molded into a U-shaped configuration thereof.

3. The versatile cleaning-used duster broom structure as claimed in claim 1 wherein the elastic soft bristles of the dusting broom body being made up of artificial wool-like material and bundled up into a hairy bunch thereof.

4. The versatile cleaning-used duster broom structure as claimed in claim 1 wherein the dusting broom body includes one or more than one layers of the collecting portions bonded to the surface of the elastic soft bristles via ultrasonic-fastening, weave-binding, or electric-thermo-pressing operation.

5. The versatile cleaning-used duster broom structure as claimed in claim 1 wherein the fixing pole being composed of an iron wire or other flexible wire material.

6. The versatile cleaning-used duster broom structure as claimed in claim 1 wherein the dusting broom body being combined with various sidelong coupling seats with handles mounted thereto, forming a horizontal-type dusting device thereby.

7. The versatile cleaning-used duster broom structure as claimed in claim 1 wherein the elastic soft bristles being wound into a twisted shape respectively and being bundled up by a flexible-wire fixing pole with a fixing end extending at both ends thereon that being coated with glue material and fastened to both internal left and right sides of the opening end of the coupling seat thereby.

8. The versatile cleaning-used duster broom structure as claimed in claim 1, wherein the elastic soft bristles of the dusting broom body being made of bamboo charcoal material.

9. The versatile cleaning-used duster broom structure as claimed in claim 1, wherein the conjoining blocks of the coupling seat being respectively defined by a front-narrow-and-rear-wide insert groove thereon.

10. A versatile cleaning-used duster broom structure, comprising:

a dusting broom body composed of elastic soft bristles, and a coupling seat equipped with a handle to fit to the dusting broom body, wherein the coupling seat has one side defined by an opening end to which the dusting broom body is accommodated and located thereto, the opening end having an interior equipped with multiple conjoining blocks each defined by an insert groove thereon, and wherein the dusting broom body has a surface bonded into a collecting portion for arranging and distributing the elastic soft bristles evenly to match to a fixing pole thereby, wherein each of the elastic soft bristles has multiple individual cellular suction portions disposed thereon, wherein the elastic soft bristles form a dense bristle surface equipped with elasticity so as to suck up fine particles of dust, wherein, via the stretchable character of the cellular suction portions thereof, the elastic soft bristles expand and bounce up to enwrap trash therein, and wherein the elastic soft bristles being wound into a twisted shape respectively and bundled up by a flexible-wire fixing pole with a fixing end extending at both ends thereon for being coated with glue material and fastened to both internal left and right sides of the opening end of the coupling seat thereby.

11. The versatile cleaning-used duster broom structure as claimed in claim 10 wherein the conjoining blocks of the coupling seat being respectively molded into a U-shaped configuration thereof.

12. The versatile cleaning-used duster broom structure as claimed in claim 10 wherein the dusting broom body includes one or more than one layers of the collecting portion bonded to the surface of the elastic soft bristles via ultrasonic-fastening, weave-binding, or electric-thermo-pressing operation.

13. The versatile cleaning-used duster broom structure as claimed in claim 10 wherein the dusting broom body being combined with various sidelong coupling seats with handles mounted thereto, forming a horizontal-type dusting device thereby.

14. The versatile cleaning-used duster broom structure as claimed in claim 10, wherein the conjoining blocks of the coupling seat being respectively defined by a front-narrow-and-rear-wide insert groove thereon.

15. A versatile cleaning-used duster broom structure, comprising:

a dusting broom body composed of elastic soft bristles, and a coupling seat equipped with a handle to fit to the dusting broom body, wherein the coupling seat has one side defined by an opening end to which the dusting broom body is accommodated and located thereto, the opening end having an interior equipped with multiple conjoining blocks each defined by an insert groove thereon, and wherein the dusting broom body has a surface bonded collecting portion for arranging and distributing the elastic soft bristles evenly to match to a fixing pole thereby, wherein each of the elastic soft bristles has multiple individual cellular suction portions disposed thereon, wherein the elastic soft bristles form a dense bristle surface equipped with elasticity so as to suck up fine particles of dust, wherein, via the stretchable character of the cellular suction portions thereof, the elastic soft bristles expand and bounce up to enwrap trash therein, and wherein the conjoining blocks of the coupling seat being respectively defined by a front-narrow-and-rear-wide insert groove thereon.

16. The versatile cleaning-used duster broom structure as claimed in claim 15 wherein the dusting broom body includes one or more than one layers of the collecting portion bonded to the surface of the elastic soft bristles via ultrasonic-fastening, weave-binding, or electric-thermo-pressing operation.

17. The versatile cleaning-used duster broom structure as claimed in claim 15 wherein the dusting broom body being combined with various sidelong coupling seats with handles mounted thereto, forming a horizontal-type dusting device thereby.

* * * * *